United States Patent [19]

Davidson et al.

[11] 4,138,681

[45] Feb. 6, 1979

[54] PORTABLE RADIO ANTENNA

[75] Inventors: Allen L. Davidson, Crystal Lake; James M. Durante, Elgin, both of Ill.

[73] Assignee: Motorola, Inc., Schaumburg, Ill.

[21] Appl. No.: 828,565

[22] Filed: Aug. 29, 1977

[51] Int. Cl.[2] ..... H01Q 1/24; H01Q 9/04; H01Q 9/38; H01Q 21/00

[52] U.S. Cl. ..... 343/702; 343/825; 343/829; 343/844

[58] Field of Search ..... 343/702, 825, 828, 829, 343/830, 831, 844, 846

[56] References Cited

U.S. PATENT DOCUMENTS

| | | | |
|---|---|---|---|
| 2,153,392 | 4/1939 | Berndt | 343/844 |
| 2,205,358 | 6/1940 | Hansell | 343/830 |
| 2,505,751 | 5/1950 | Bolljahn | 343/708 |
| 3,579,241 | 5/1971 | Antista et al. | 343/702 |

*Primary Examiner*—Alfred E. Smith

*Assistant Examiner*—Harry E. Barlow

*Attorney, Agent, or Firm*—James P. Hamley; James W. Gillman

[57] ABSTRACT

An antenna for a hand-held radio transceiver includes first and second elements extending from the radio's case. The first element is comprised of a pair of series coupled members having electrical lengths of one-half and one-quarter wavelength, respectively, with the free end of the second member being coupled to the transmitter output. The second element couples to the radio's electrical ground and is configured to form a transmission line with the second member. The effective electrical length of the second element, including the influence of the elements parasitic coupling to the radio, is adjusted to be one-quarter wavelength.

The resulting antenna structure minimizes surface currents across the radio's body, thereby substantially eliminating power loss caused by absorption in the user's body.

10 Claims, 3 Drawing Figures

PORTABLE RADIO ANTENNA

BACKGROUND OF THE INVENTION

The present invention pertains to the radio communication art and, more particularly, to a radio/antenna combination.

The radio communication art has developed numerous antenna configurations for use in combination with radio transmitters and/or receivers. Of particular relevance to the instant invention, are antennas developed for use in portable, or hand-held radio transceivers. Two prominent such prior art antennas are the sleeve dipole and the two wire "J" match antenna. A common construction of the sleeve dipole utilizes coaxial cable wherein the outer conductor, or braid of the coax extends back over the cable for an electrical length of one-quarter wavelength at the frequency of interest. The center conductor of the cable extends beyond the folded back joint of the outer conductor for a distance of one-quarter wavelength. Thus, the extended center conductor and outside of the folded back braid comprise a half wavelength dipole. The coaxial line formed by the folded back outer conductor and the outer conductor of the original cable form a short circuited quarter wavelength line thereby creating a choke which tends to limit current to the half wavelength radiator.

A "J" matched antenna is comprised of a half wavelength section fed by a transmission line. The transmission line is generally a quarter wavelength long, thus acting as an impedance transformer to provide a match between the transmitter and the antenna element. When fed by a balanced line, the quarter wave transmission line is generally shorted, with the feed line connected at predetermined taps on the transmission line section. For unbalanced feed conditions, such as coaxial cable, the transmission line is open at both ends, with the feed lines connecting to each of the open ends of the transmission lines.

Tests conducted on both of the above described antenna types have shown that neither is totally suitable for certain applications. For example, in portable communication devices, such as hand held radio transmitters, it is extremely important that the antenna be decoupled from the radio. If surface currents from the antenna exist along the case of the radio two undesired effects result. Firstly, the radiated power, or received energy, of the radio is significantly degraded due to $I^2R$ losses in the hand, or body of the user. Moreover, in many applications a positive feedback loop can be established whereby circuitry within the radio is caused to oscillate due to feedback from the antenna element.

SUMMARY OF THE INVENTION

It is an object of this invention, therefore, to provide an improved radio/antenna combination which significantly minimizes surface currents along the body of the radio.

It is a particular object of the invention to provide the above described radio/antenna combination in a form particularly adapted for application in portable radios.

Briefly, according to the invention, the radio/antenna combination is designed for operation on a wavelength $\lambda$ and comprises a radio body which includes radio circuitry having first and second antenna connections. The antenna comprises a first radiating element which extends from the radio body and which is electrically coupled to the first antenna connection. The length of the first antenna element is predetermined and, preferably, is equal to $3\lambda/4$. A second antenna radiating element, which extends from the radio body and which is electrically coupled to the body and to the second antenna connection, is in a predetermined electrically coupled relationship with the first element. Further, its effective electrical length, including the influence of the radio body, minimizes the current distribution along the radio body. Preferably, the second radiating element has an effective electrical length of $\lambda/4$.

DETAILED DESCRIPTION OF THE PREFERRED EMBODIMENT OF THE INVENTION

Figure 1:
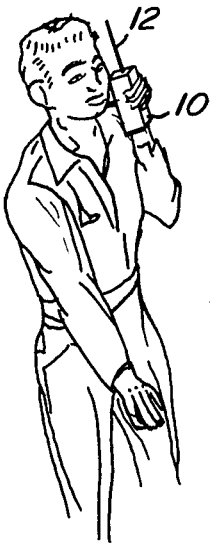
FIG. 1 illustrates a typical portable radio/antenna combination being operated by a user.

FIG. 1 illustrates a typical portable radio/antenna combination including a radio case 10 and an extending antenna element 12. As shown, the case is being held by an operator in a typical manner for such units. The abovementioned sleeve dipole or "J" match type antenna configurations have been considered for applications such as the antenna 12. However, these prior art type antennas exhibit two basic problems due to the fact that current from the antenna element 12 is coupled across the radio case 10. Firstly, case current and antenna radiation are largely absorbed by the user's body (in the case of FIG. 1, case current is absorbed by the user's hand whereas antenna radiation is absorbed by the users body, particularly the users head) thereby significantly reducing the effective radiation power from, or received power by, the radio/antenna combination. Secondly, in some applications radiation from the antenna element 12 and/or current across the case are fed back to circuitry included within the case 10 whereby regeneration, or undesirable oscillations may result.

Figure 2:
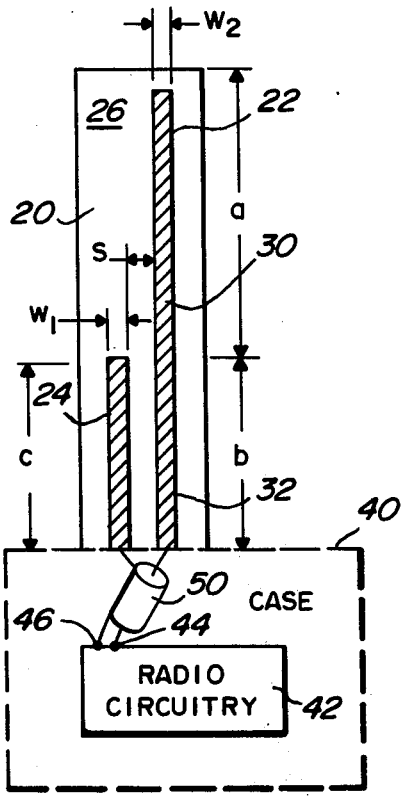
FIG. 2 illustrates the preferred embodiment of the antenna/radio combination according to the instant invention.

FIG. 2 illustrates the preferred embodiment of the radio/antenna combination according to the invention which overcomes the problems of the sleeve dipole and "J" matched antennas. Here, the antenna 20 is comprised of first and second antenna elements 22, 24, respectively. The outlines 22, 24 are, preferably, copper depositions on a board 26 fabricated from suitable dielectric. Thus, the entire antenna structure 20 may be constructed in printed circuit form.

The first antenna element 22 is comprised of a pair of series coupled members 30, 32 having electrical lengths of a and b, respectively. Preferably, the electrical length a of the first member 30 is tuned to be one-half wavelength at the desired frequency of operation. In general, however, an integral multiple of one-half wavelength may be utilized. Thus, the generalized electrical length of the first member a is given by: $a = m\lambda/2$, where $m = 1, 2, 3 \ldots$ and $\lambda$ is the wavelength of the frequency of interest.

The electrical length b of the second member 32 is, preferably, one-quarter wavelength but, in general may be given generally as: $b = n\lambda/4$, where $n = 1, 3, 5 \ldots$ The second antenna element 24 is located in predetermined configuration with respect to the second member 32 of the first element 22 such that member 32 and element 24 form a transmission line. Since the length of member a is one-half wavelength, the impedance at the connecting point of member 30 and member 32 is very high and thus would not be matched to the transmitter output circuitry. Thus, the widths $w_1$, $w_2$ of element 24 and member 32, as well as the spacing s between the element and member are designed such that the impedance at the feed point of the antenna is the desired value. Further, as will be described more fully herein below, element 24 has an electrical length c which is designed to minimize antenna surface currents from appearing along the radio.

The antenna structure 20 is mounted to, and extends from the radio case 40. Contained within the radio case 40 is radio circuitry 42, of conventional design. The radio circuitry 42 has first and second antenna connections 44, 46, respectively. A standard piece of coaxial cable 50 couples the antenna structure 20 to the antenna connections 44, 46. As is shown, the center conductor of the coax 50 couples the first antenna connection 44 to the first antenna element 22, whereas the ground, or outer conductor of the coax 50 couples between the second antenna connector 46 and the second antenna element 24.

Figure 3:
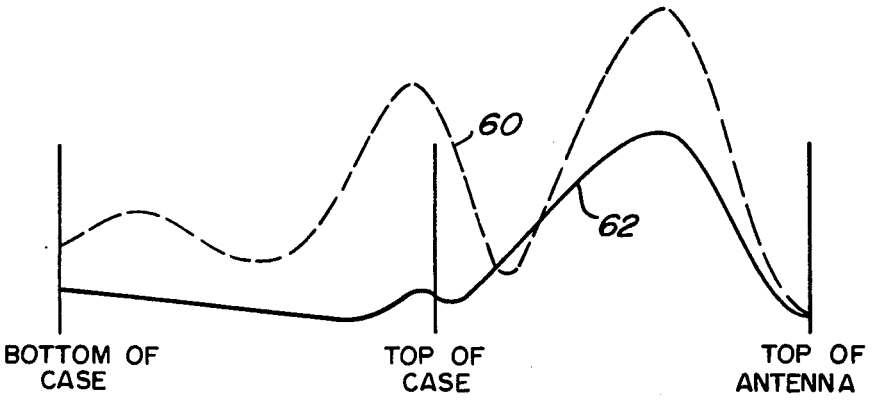
FIG. 3 illustrates graphically the reduction of current distribution along the radio body of the instant invention over prior art designs.

In initial construction of the antenna structure 20, the electrical length c of the second element 24 was designed to be one-quarter of a wavelength ($\lambda/4$). This resulted in the current distribution labeled graph 60 in FIG. 3. Here it can be seen that the current distribution across the case of the radio was significant and not only resulted in absorption of power by the user's hand but also tended to cause oscillation due to a feedback loop created back within the radio circuitry 42 as shown in FIG. 2.

It was then realized that, due to coupling between the second antenna element 24 and the radio circuitry 42, the effective electrical length c of element 24 was not the same as its actual mechanical length of one-quarter wavelength. That is, the radio circuitry 42, being largely metallic in nature, has a significant influence on the effective electrical length c of second element 24. At that point, the actual length of the second element 24 was varied until, finally, the current distribution illustrated as graph 62 in FIG. 3 was derived. Here, it can be seen that the current distribution across the case 40 of the radio is effectively reduced to a minimum whereby the aforementioned problem of reduced radiated power and the possibility of circuit oscillation was totally eliminated. Thus, the designed actual length of element 24 in this, the preferred embodiment of the invention, is given by the equation: $c = \lambda/4 - \epsilon$, where $\epsilon$ is a factor which takes into account the influence of the radio circuitry, such that the resulting effective electrical length of the second element 24 is one-quarter wavelength. In general, as with second member 32, the effective electrical length of the second element 24 may be given as: $c = n\lambda/4$, where $n = 1, 3, 5 \ldots$ In the working embodiment of the antenna, designed for operation at 821.0125 megahertz, the following dimensions were used:

a = 6.6 inches (16.764 mm)
b = 3.47 inches (8.81 mm)
c = 2.72 inches (6.91 mm)
$w_1$, $w_2$ = 0.105 inches (0.27 mm)
s = 0.24 inches (0.61 mm)

As mentioned herein above, the length c of the second element 24 must be adjusted, empirically if necessary, until its effective length, including the coupling due to the radio circuitry, is an odd multiple of one-quarter wavelength.

In some applications, it is readily apparent to one of ordinary skill in this art that a lump constant matching circuit might be placed between the radio circuitry and the antenna structure to provide the desired matching between the radio circuitry and the antenna or to provide a desired voltage standing wave ratio.

In summary, an improved radio/antenna combination has been described which includes means to significantly minimize currents along the radio's case.

While a preferred embodiment of the invention has been described in detail, it should be understood that many modifications and variations thereto are possible, all of which fall within the true spirit and scope of the invention.

We claim:

1. A radio/antenna combination for operation on a wavelength $\lambda$ comprising:

a radio body including radio circuitry having first and second antenna connections; and an antenna comprising:

a first radiating element, extending from said body, and being electrically coupled to said first antenna connection, said first radiating element having a predetermined electrical length; and a second radiating element, extending from said body and being electrically coupled to said body and said second antenna connection, said second radiating element being in predetermined electrically mutually coupled relationship with said first radiating element and having a predetermined effective electrical length such that upon transmission by said radio the current distribution along the radio body is minimized.

2. The radio/antenna combination of claim 1 wherein the first and second radiating elements are of predetermined dimensions and are predeterminedly spaced such that said antenna exhibits a predetermined impedance at said antenna connections.

3. The radio/antenna combination of claim 1 wherein said first radiating element is comprised of first and second series, mutually coupled members, said first member having an electrical length of approximately $m\lambda/2$, where $m = 1, 2, 3 \ldots$, said second member having an electrical length of approximately $n\lambda/4$, where $n = 1, 3, 5 \ldots$, said first antenna connection being coupled to said second member.

4. The radio/antenna combination of claim 3 wherein:

said second radiating element is in a predetermined configuration with said second member to form a transmission line therewith, with the effective electrical length of said second radiating element, including the influence of said second member being electrically coupled to said radio body, being approximately $n\lambda/4$, where $n = 1, 3, 5 \ldots$

5. The radio/antenna combination of claim 4 wherein the first and second radiating elements are of predetermined dimensions and are predeterminedly spaced such that said antenna exhibits a predetermined impedance at said antenna connections.

6. A radio/antenna combination for operation on a wavelength $\lambda$ comprising:

a radio body including radio circuitry having first and second antenna connections; and an antenna comprising:

a first radiating element comprising first and second series connected radiating members, said first member having an electrical length of approximately $M\lambda/2$, where $m = 1, 2, 3 \ldots$, said second member having an electrical length of approximately $n\lambda/4$, where $n = 1, 3, 5 \ldots$, said first radiating element extending from said radio body with said first antenna connection being coupled to said second radiating member; and a second radiating element, extending from said radio, and being electrically coupled to said radio body and to said second antenna connection, the second radiating element having a predetermined electrical length and being in predetermined configuration with said second member to form a transmission line therewith, such that upon transmission of energy by said radio over the antenna, current along said radio body is substantially inhibited.

7. The radio/antenna combination of claim 6 wherein the electrical length of said second radiating element, including the influence of said second radiating element being electrically coupled to the radio body, is approximately equal to the electrical length of said second member.

8. The radio/antenna combination of claim 6 wherein the first and second radiating elements are of predetermined dimensions and are predeterminedly spaced such that said antenna exhibits a predetermined impedance at said antenna connections.

9. A radio/transmitter antenna combination for operation on a wavelength $\lambda$ comprising:

a radio body including radio circuitry having first and second antenna connections; and an antenna comprising:

a first radiating element comprising first and second series connected radiating members, said first member having an electrical length of approximately $m\lambda/2$, where $m = 1, 2, 3, \ldots$, said second member having an electrical length of approximately $n\lambda/4$, where $n = 1, 3, 5 \ldots$, said first radiating element extending from said radio body with said first antenna connection being coupled to said second radiating member; and a second radiating element extending from said radio being electrically coupled to said radio body and to said second antenna connection, the second radiating element having an effective electrical length, including the influence of said second radiating element being electrically coupled to the radio body, approximately equal to said second member, with said second radiating element being in predetermined configuration with the second member to form an $n\lambda/4$ length transmission line therewith.

10. The radio transmitter/antenna combination of claim 9 wherein the first and second radiating elements are of predetermined dimensions and are predeterminedly spaced such that said antenna exhibits a predetermined impedance at said antenna connections.

* * * * *